US007909006B2

(12) United States Patent
Tateno et al.

(10) Patent No.: US 7,909,006 B2
(45) Date of Patent: Mar. 22, 2011

(54) VARIABLE VALVE MECHANISM

(75) Inventors: Manabu Tateno, Sunto-gun (JP); Shuichi Ezaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 291 days.

(21) Appl. No.: 12/309,644

(22) PCT Filed: Dec. 26, 2007

(86) PCT No.: PCT/JP2007/074910

§ 371 (c)(1),
(2), (4) Date: Jan. 26, 2009

(87) PCT Pub. No.: WO2008/090709

PCT Pub. Date: Jul. 31, 2008

(65) Prior Publication Data

US 2009/0320779 A1 Dec. 31, 2009

(30) Foreign Application Priority Data

Jan. 26, 2007 (JP) ..... 2007-015992

(51) Int. Cl.
*F01L 1/34* (2006.01)

(52) U.S. Cl. ..... 123/90.16; 123/90.15; 123/90.17

(58) Field of Classification Search ..... 123/90.15, 123/90.16, 90.17, 90.31
See application file for complete search history.

(56) References Cited

U.S. PATENT DOCUMENTS 6,425,357 B2 * 7/2002 Shimizu et al. ..... 123/90.16
2004/0231625 A1 11/2004 Sugiura et al.

FOREIGN PATENT DOCUMENTS

| | | |
|---|---|---|
| JP | A-2004-183518 | 7/2004 |
| JP | A-2005-009446 | 1/2005 |
| JP | A-2005-201077 | 7/2005 |
| JP | A-2005-256653 | 9/2005 |
| JP | A-2006-161730 | 6/2006 |
| JP | A-2007-064181 | 3/2007 |

* cited by examiner

*Primary Examiner* — Zelalem Eshete
(74) *Attorney, Agent, or Firm* — Oliff & Berridge, PLC

(57) ABSTRACT

Disclosed is a variable valve mechanism for an internal combustion engine. The variable valve mechanism accurately adjusts the valve operating angle although its structure is simple. The variable valve mechanism includes a control pin 48, which is inserted into a pin insertion hole 38 in a control shaft 16; a bearing hole 44, which is formed in a control member 26; and an adjustment pin 50, which is rotatably supported by the bearing hole 44. The adjustment pin 50 comes into surface contact with the control pin 48 to inhibit the control member 26 from rotating relative to the control shaft 16. The valve operating angle is adjusted by replacing the adjustment pin 50 with another having a different dimension B. Such adjustment pin replacement changes the distance A between the center line of the bearing hole 44 and the center line of the control pin 48, thereby changing the relative angle θ between the control shaft 16 and control member 26. When the adjustment pin 50 rotates within the bearing hole 44, the surface contact between the adjustment pin 50 and control pin 48 is maintained irrespective of the magnitude of the relative angle θ.

8 Claims, 6 Drawing Sheets

VARIABLE VALVE MECHANISM

TECHNICAL FIELD

The present invention relates to a variable valve mechanism.

BACKGROUND ART

A variable valve mechanism disclosed in JP-A-2006-161730 includes: a control shaft, which is capable of varying the rotary angular position continuously or stepwise; a control member, which is mounted on the outer circumferential surface of the control shaft to rotate together with the control shaft; and a change mechanism, which changes the valve operating angle relative to camshaft rotation in accordance with the rotary angular position of the control member. In this variable valve mechanism, the control shaft is shared by a plurality of cylinders while the control member is provided for each cylinder.

In the above variable valve mechanism, the valve operating angle may vary from one cylinder to another due to a component part manufacturing error or assembling error. Therefore, the above variable valve mechanism includes an adjustment mechanism, which equalizes the valve operating angles of all cylinders as described below. An insertion hole is made in the control member. Further, a protruding part, which is formed to be smaller than the insertion hole in circumferential width, is positioned to protrude into the insertion hole from the control shaft. There are gaps between the protruding part and the left and right circumferential wall surfaces of the insertion hole. Adjustment members (adjustment shims) are placed in the left and right gaps. The mounting angle of the control member relative to the control shaft can be adjusted by replacing the left and right adjustment members with those having a different shape. When the adjustment is made for all cylinders, the valve operating angles of all cylinders can be equalized.

Patent Document 1: JP-A-2006-161730

Patent Document 2: JP-A-2005-9446

DISCLOSURE OF THE INVENTION

Problem to be Solved by the Invention

In the prior art variable valve mechanism described above, the gaps into which the adjustment members are inserted are shaped like a wedge. The angle of the wedge varies with the adjustment of the mounting angle of the control member relative to the control shaft. Therefore, uneven contact, point contact, or other improper contact may occur in a region of contact between the control member insertion hole and adjustment members or between the protruding part and adjustment members. If uneven contact or point contact occurs, the surface pressure of the associated contact face increases, thereby accelerating wear. If wear progresses, the adjusted mounting angle becomes incorrect. This causes the valve operating angle to become incorrect as well.

The present invention has been made in view of the above circumstances. It is an object of the present invention to provide a variable valve mechanism with simple structure that is capable of accurately adjusting the valve operating angle of an internal combustion engine.

Means for Solving the Problem

The above object is achieved by a first aspect of the present invention. The first aspect of the present invention is a variable valve mechanism including:

a cam which is mounted on a camshaft of an internal combustion engine;

an intermediate member which is positioned in the course of a path for transmitting the lift of the cam to a valve;

a control shaft which can vary the rotary angular position continuously or stepwise;

a control member which is installed to be rotatable around the control shaft;

a lock mechanism for preventing the control member from rotating relative to the control shaft; and a coupling member for coupling the control member to the intermediate member;

the control shaft being rotated to change the position of the intermediate member and the operating angle of the valve is varied;

wherein the lock mechanism includes a control pin, which is inserted into a hole in the control shaft to protrude in the radial direction of the control shaft, a bearing hole, which is formed in the control member in parallel with the control shaft, and an adjustment member, which is rotatably supported by the bearing hole;

wherein the adjustment member and the control pin come into surface contact with each other directly or through an interposition member to inhibit the control member from rotating relative to the control shaft;

wherein the operating angle of the valve can be adjusted by replacing the adjustment member, the interposition member, or the control pin with another having a different dimension to change the distance between the center line of the bearing hole and the center line of the control pin and change the relative angle between the control shaft and the control member; and wherein the adjustment member rotates within the bearing hole to maintain the surface contact irrespective of the magnitude of the relative angle.

A second aspect of the present invention is the variable valve mechanism according to the first aspect, wherein the adjustment member is made of a substantially cylindrical pin.

A third aspect of the present invention is the variable valve mechanism according to the first or the second aspect, wherein the surface contact is plane contact.

A fourth aspect of the present invention is the variable valve mechanism according to any one of the first to the third aspects, wherein the adjustment member and the control pin are in direct contact with each other; and wherein the operating angle of the valve can be adjusted by replacing the adjustment member with another having a different dimension between the center line thereof and the contact face relative to the control pin or by replacing the control pin with another having a different dimension between the center line thereof and the contact face relative to the adjustment member.

A fifth aspect of the present invention is the variable valve mechanism according to any one of the first to the fourth aspects, wherein the adjustment member and the control pin are in direct contact with each other;

wherein the adjustment member has cylindrical parts, which are provided on both ends and in contact with the inner circumferential surface of the bearing hole; and wherein the adjustment member's contact face relative to the control pin is positioned between the cylindrical parts and lower than the cylindrical surfaces thereof.

A sixth aspect of the present invention is the variable valve mechanism according to any one of the first to the fifth aspects, wherein the control pin is inserted into the hole in the control shaft in a clearance-fit manner;

wherein the adjustment member and the control pin are in direct contact with each other; and wherein the control pin has a protruding part, which is positioned between the contact face relative to the adjustment member and an insert placed in the hole in the control shaft.

A seventh aspect of the present invention is the variable valve mechanism according to any one of the first to the sixth aspects, wherein the lock mechanism further includes a screw hole bored through the adjustment member, a bolt insertion hole bored through the control pin, a bolt for fastening the adjustment member to the control pin by running through the bolt insertion hole and screwing into the screw hole, and a nut screwed on a male thread of the bolt protruding through the screw hole; and wherein a gap is provided between the bolt insertion hole and the bolt to allow a bolt position change that occurs when the relative angle between the control shaft and the control member is changed.

A eighth aspect of the present invention is the variable valve mechanism according to any one of the first to the seventh aspects, further including:

a rocker arm for pushing the valve;

a rocker roller which is mounted on the rocker arm;

a swing arm which is installed to be swingable around the control shaft and swings when the cam rotates;

a swing cam surface which is formed on the swing arm and brought into contact with the rocker roller; and a slider surface which is formed on the swing arm and positioned to face the cam;

wherein the intermediate member is positioned between the cam and the slider surface to move toward or away from the center of the control shaft when the control shaft rotates.

ADVANTAGES OF THE INVENTION

According to the first aspect of the present invention, when, for instance, valve operating angle variations between the cylinders of an internal combustion engine are to be compensated for, the valve operating angle can be adjusted by replacing the adjustment member, interposition member, or control pin with another having a different dimension for the purpose of adjusting the relative angle (mounting angle) between the control shaft and control member. The adjustment member is rotatably supported by the bearing hole, which is made in the control member. Therefore, when the adjustment member rotates, it can absorb changes in the relative angle between the control shaft and control member. Thus, the surface contact between the adjustment member and control pin can be properly maintained. This makes it possible to accurately prescribe the relative angle between the control shaft and control member and adjust the operating angle with high precision. Further, the surface pressure of the contact face between the adjustment member and control pin can be decreased to inhibit the contact face from wearing. This makes it possible to definitely prevent an adjusted operating angle from becoming incorrect. Further, the first aspect of the present invention entails the use of a small number of parts, does not require the parts to be manufactured with high dimensional accuracy, and makes it easy to fabricate the parts. Consequently, the production cost can be reduced. In addition, assembly can be easily achieved to provide increased productivity.

According to the second aspect of the present invention, the adjustment member can be made of a substantially cylindrical pin. This makes it possible to fabricate the adjustment member with increased ease and achieve assembly with increased ease.

According to the third aspect of the present invention, the direct or indirect surface contact between the adjustment member and control pin can be plane contact. This makes it possible to decrease the surface pressure of the contact face with increased certainty, thereby preventing the contact face from wearing with increased certainty.

According to the fourth aspect of the present invention, the adjustment member can be brought into direct contact with the control pin. Further, the valve operating angle can be adjusted by replacing the adjustment member with another having a different dimension or by replacing the control pin with another having a different dimension. Since this eliminates the need for the interposition member, the number of required parts can be further reduced.

According to the fifth aspect of the present invention, the adjustment member has a cylindrical part on either side of the contact face that is in contact with the control pin. The surface of the cylindrical part is higher than the contact face. The cylindrical part definitely prevents the adjustment member from backing out of the bearing hole without requiring the use of any additional part. This makes it possible to further reduce the number of required parts.

According to the sixth aspect of the present invention, the control pin can be inserted into the hole in the control shaft in a clearance-fit manner. Since this eliminates the need for press in, assembly can be achieved with increased ease. Further, the control pin has a protruding part that retains the control pin. This makes it possible to definitely prevent the control pin from backing out of the hole in the control shaft without requiring the use of any additional part. Consequently, the number of required parts can be further reduced.

According to the seventh aspect of the present invention, a bolt can be inserted into a bolt insertion hole made in the control pin and screwed into a screw hole made in the adjustment member for tightening purposes. Therefore, the adjustment member and control pin can be secured together. Further, when a nut is screwed on the male thread of the bolt protruding through the screw hole in the adjustment member, a double-nut effect is produced. This makes it possible to prevent bolt looseness with increased certainty. Further, when the operating angle is adjusted to change the relative angle between the control shaft and control member, the positional relationship between the control pin and bolt changes. According to the seventh aspect of the present invention, a gap exists between the bolt insertion hole and bolt to allow such bolt position changes. Therefore, when the operating angle is adjusted, the surface contact between the control pin and adjustment member can be certainly maintained.

According to the eighth aspect of the present invention, the valve operating angle changes when the intermediate member positioned between the cam and the slider surface of the swing arm is moved toward or away from the center of the control shaft. More specifically, moving the intermediate member toward the center of the control shaft increases the swing range of the swing arm, thereby increasing the operating angle. Conversely, moving the intermediate member away from the center of the control shaft decreases the swing range of the swing arm, thereby decreasing the operating angle.

BEST MODE FOR CARRYING OUT THE INVENTION

Figure 1:
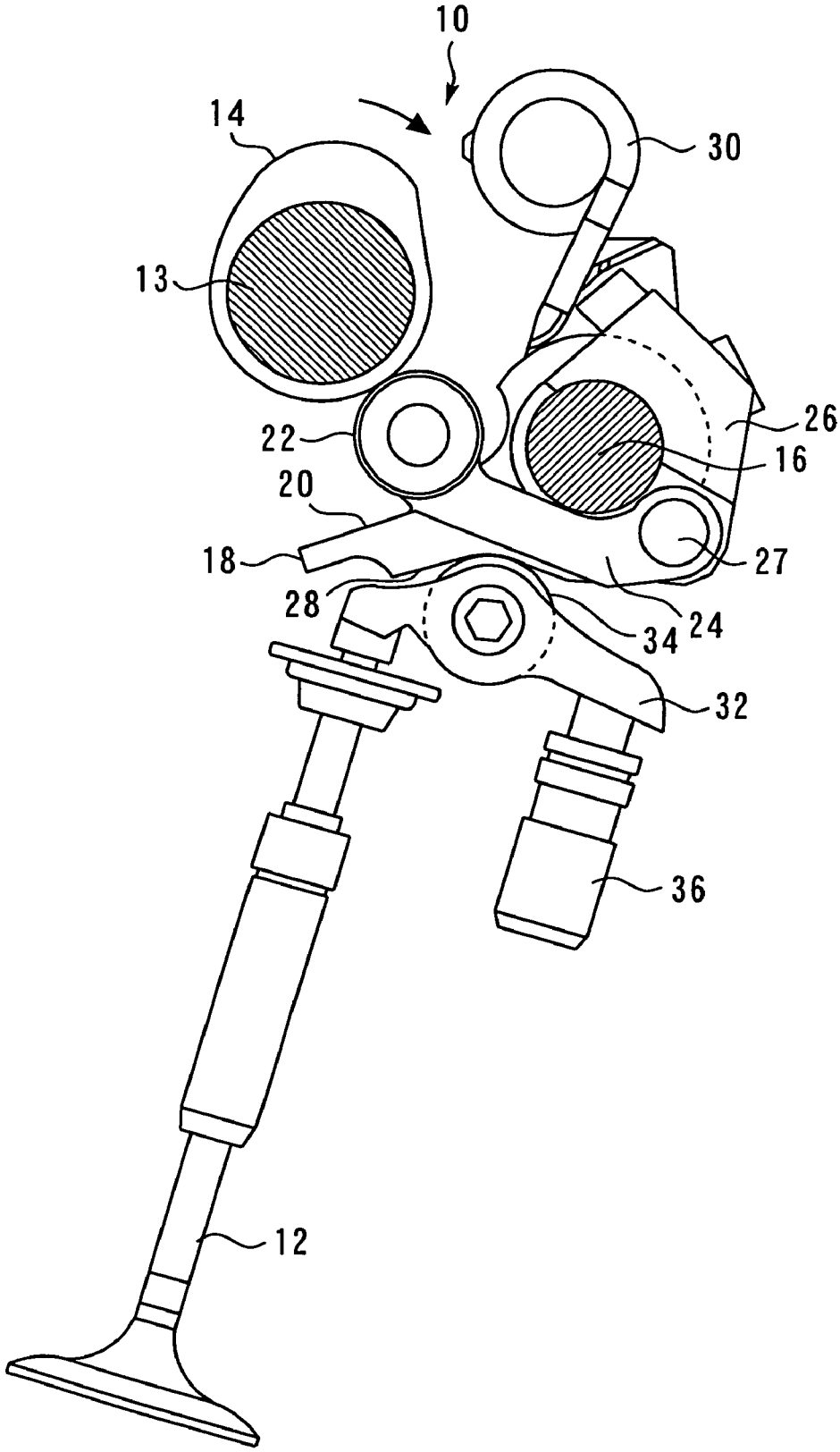
FIG. 1 is a side view illustrating a variable valve mechanism according to a first embodiment of the present invention.

Embodiments of the present invention will now be described with reference to the accompanying drawings. Like elements in the drawings are designated by the same reference numerals and will not be redundantly described.

First Embodiment

FIG. 1 is a side view illustrating a variable valve mechanism according to a first embodiment of the present invention. The following description assumes that the variable valve mechanism 10 shown in FIG. 1 drives an intake valve 12 of an internal combustion engine. However, the present invention can also be applied to a variable valve mechanism that drives an exhaust valve.

The variable valve mechanism 10 includes a cam 14, which is mounted on a camshaft 13. The camshaft 13 is rotationally driven by a crankshaft of the internal combustion engine. The cam 14 rotates clockwise as viewed in FIG. 1.

The variable valve mechanism 10 also includes a control shaft 16, which is positioned in parallel with the camshaft 13, and a control shaft drive mechanism (not shown), which can rotate the control shaft 16 within a predetermined angular range. The configuration of the control shaft drive mechanism is not specifically defined. However, the control shaft drive mechanism may be composed, for instance, of a worm wheel, which is fastened to one end of the control shaft 16; a worm gear, which meshes with the worm wheel; and a servomotor, which rotationally drives the worm gear. When such a configuration is employed, the rotary angular position of the control shaft 16 can be controlled by regulating the rotation direction and rotation amount of the servomotor.

The variable valve mechanism 10 also includes a swing arm (swing cam arm) 18. The swing arm 18 is adapted to swing around the center of the control shaft 16. The swing arm 18 has a slider surface 20, which faces the cam 14.

A slider roller 22 is positioned between the swing arm 18 and cam 14. The slider roller 22 is rotatably supported by the leading end of an intermediate arm 24. The base end of the intermediate arm 24 is pivotally coupled to a control member 26 by a coupling shaft 27. The control member 26 rotates together with the control shaft 16. Therefore, when the control shaft 16 rotates, displacement is transmitted through the control member 26 and intermediate arm 24 to move the slider roller 22.

More specifically, when the control shaft 16 rotates clockwise in a state shown in FIG. 1, the slider roller 22 moves away from the swing center of the swing arm 18 (that is, the center of the control shaft 16). When the control shaft 16 rotates counterclockwise in a state where the slider roller 22 is positioned apart from the center of the control shaft 16, the slider roller 22 is pulled by the intermediate arm 24 to approach the center of the control shaft 16. FIG. 1 shows a state where the slider roller 22 is positioned close to the center of the control shaft 16.

The slider surface 20 is curved, for instance, to form an arc so that the distance to the center of the camshaft 13 gradually increases with a decrease in the distance to the leading end of the swing arm 18. The swing arm 18 also has a swing cam surface 28, which is positioned opposite the slider surface 20.

A lost motion spring 30 pushes the swing arm 18 clockwise as viewed in FIG. 1. This pushing force presses the swing arm 18 against the slider roller 22 and presses the slider roller 22 against the cam 14.

The variable valve mechanism 10 further includes a rocker arm 32, which pushes a valve stem of the intake valve 12 in the lifting direction. The rocker arm 32 is positioned below the swing arm 18 as viewed in FIG. 1. A rocker roller 34 is rotatably attached to the middle of the rocker arm 32. The rocker roller 34 is in contact with the swing cam surface 28. One end of the rocker arm 32 abuts on an end of the valve stem of the intake valve 12. The other end of the rocker arm 32 is supported by a hydraulic lash adjuster 36. A valve spring (not shown) pushes the intake valve 12 in the closing direction, that is, in the direction of pushing the rocker arm 32 upward. This pushing force and the hydraulic lash adjuster 36 press the rocker roller 34 against the swing cam surface 28 of the swing arm 18.

When the cam 14 in the variable valve mechanism 10 described above rotates, the swing arm 18 swings because the lift of the cam 14 is transmitted to the swing arm 18 through the slider roller 22.

As shown in FIG. 1, when the slider roller 22 is positioned nearest the center of the control shaft 16, the lift of the cam 14 is transmitted to the swing arm 18 at a position close to the center of the control shaft 16. This increases the swing range (oscillation range) of the swing arm 18. Consequently, the operating angle and maximum lift amount of the intake valve 12 increase. Conversely, when the slider roller 22 is positioned apart from the center of the control shaft 16, the lift of the cam 14 is transmitted to the swing arm 18 at a position apart from the center of the control shaft 16. This decreases the swing range (oscillation range) of the swing arm 18. Consequently, the operating angle and maximum lift amount of the intake valve 12 decrease.

As such being the case, the variable valve mechanism 10 can continuously vary the operating angle of the intake valve 12 by rotating the control shaft 16 to move the slider roller 22. More specifically, changing the rotary angular position of the control shaft 16 clockwise as viewed in FIG. 1 decreases the operating angle of the intake valve 12. Conversely, changing the rotary angular position of the control shaft 16 counterclockwise as viewed in FIG. 1 increases the operating angle of the intake valve 12.

The camshaft 13 and control shaft 16, which have been described as component parts of the variable valve mechanism 10, are shared by a plurality of cylinders of the internal combustion engine. However, the other above-described component parts are provided for each cylinder.

When an internal combustion engine equipped with the variable valve mechanism 10 is assembled, the operating angle of the intake valve 12 usually varies from one cylinder to another due, for instance, to a component part manufacturing error or assembling error. If the operating angle of the intake valve 12 varies from one cylinder to another, the amount of air also varies from one cylinder to another, thereby adversely affecting the operation of the internal combustion engine. To avoid such a problem, the variable valve mechanism 10 includes an operating angle adjustment mechanism, which is capable of adjusting the operating angle of the intake valve 12 on an individual cylinder basis in order to compensate for intake valve operating angle variations between the cylinders. The configuration of the operating angle adjustment mechanism will now be described.

Figure 2:
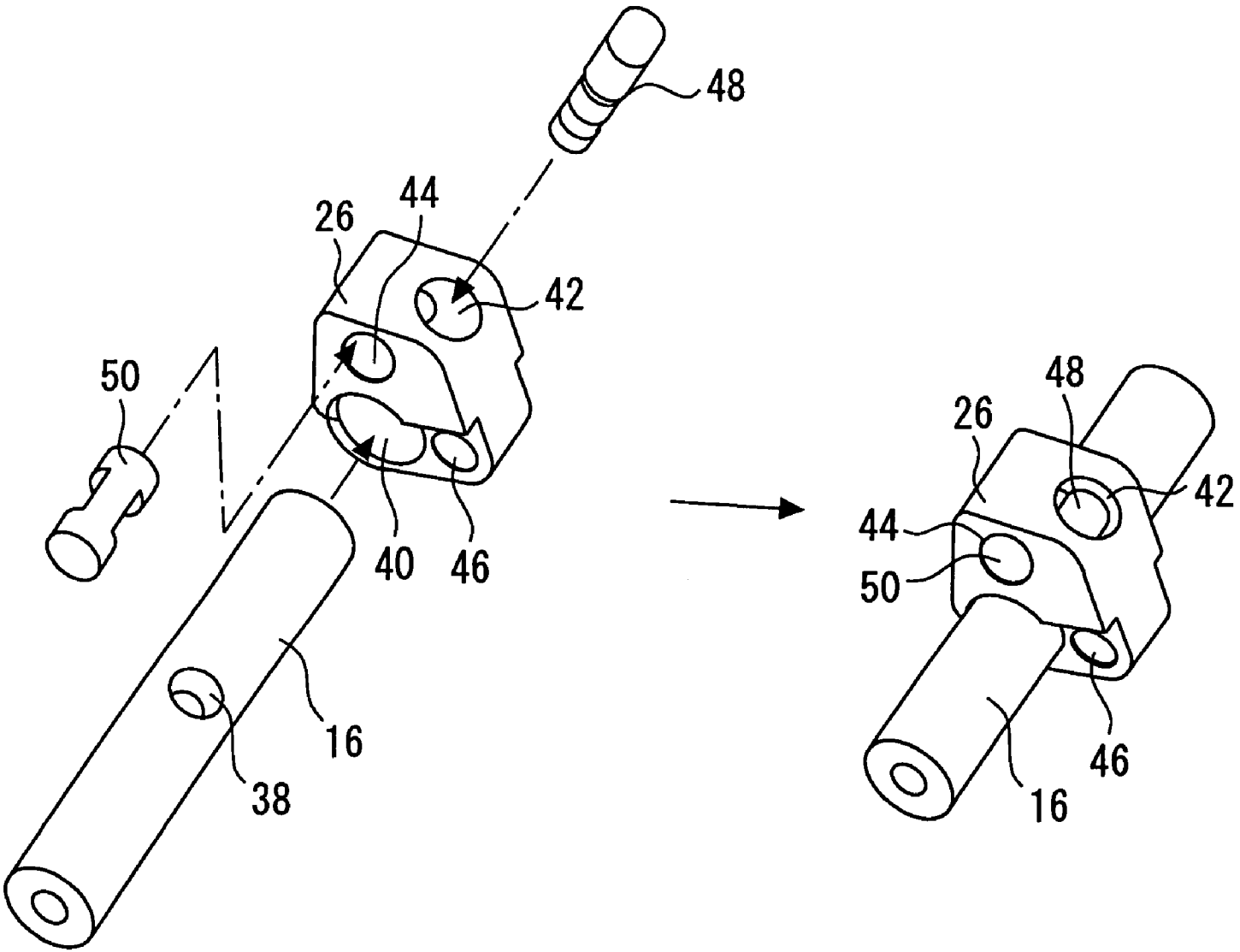
FIG. 2 shows perspective views illustrating a exploded state and assembled state of a control shaft and a control member.

FIG. 2 shows perspective views illustrating the exploded state and assembled state of the control shaft 16 and control member 26. As indicated in the left view of FIG. 2, a pin insertion hole 38 is formed in the control shaft 16 and oriented orthogonally to its axial direction. On the other hand, the control member 26 has a control shaft insertion hole 40 into which the control shaft 16 is to be inserted; a pin receiver hole 42, which is oriented orthogonally to the axial direction of the control shaft 16; a bearing hole 44, which is oriented in parallel with the control shaft 16; and another bearing hole 46 into which the coupling shaft 27 for the intermediate arm 24 is to be inserted.

When the control shaft 16 and control member 26 are to be assembled, the control shaft 16 is first inserted into the control shaft insertion hole 40 in the control member 26. Next, a control pin 48 is inserted into the pin receiver hole 42 in the control member 26 and then into the pin insertion hole 38 in the control shaft 16. In addition, an adjustment pin 50 is inserted into the bearing hole 44. The control shaft 16 and control member 26 are now assembled as indicated in the right view of FIG. 2.

As indicated in the left view of FIG. 2, the adjustment pin 50 is substantially cylindrical (shaped like a column). More specifically, the adjustment pin 50 is obtained by trimming the axial center of the column to make it flat. When the adjustment pin 50 is inserted into the bearing hole 44, the cylindrical portions on both ends are in contact with the inner circumferential surface of the bearing hole 44. The portion of the control pin 48 that is to be inserted into the pin insertion hole 38 is cylindrical; however, the portion of the control pin 48 that protrudes beyond the control shaft 16 to face the adjustment pin 50 is flat. In the assembled state, the flat portion of the adjustment pin 50 is in contact (surface contact) with the flat portion of the control pin 48.

Figure 3:
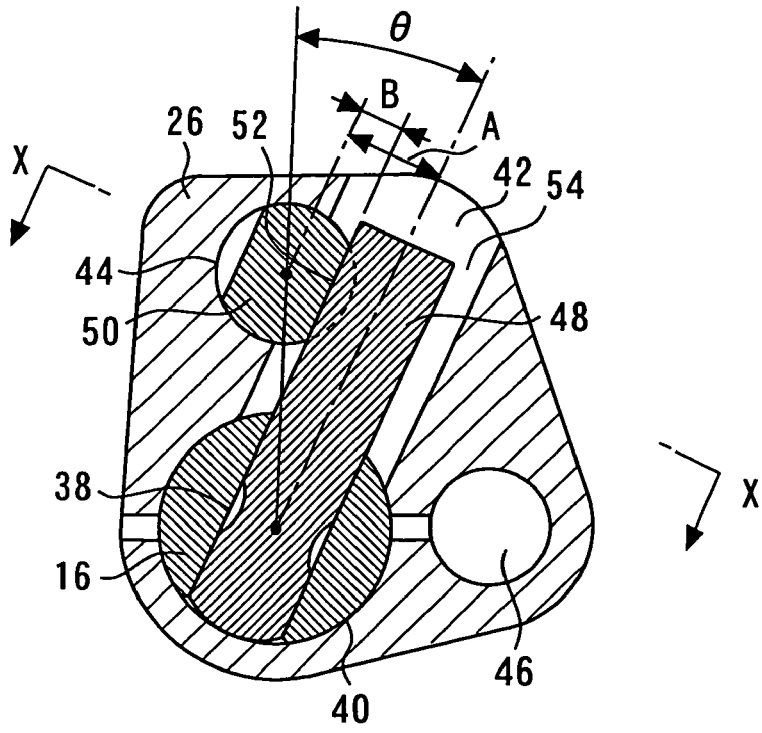
FIG. 3 is a cross-sectional view of the assembled control shaft and control member taken in a plane perpendicular to the control shaft.

FIG. 3 is a cross-sectional view of the assembled control shaft 16 and control member 26 taken in a plane perpendicular to the control shaft 16. In the present embodiment, the control pin 48 and pin insertion hole 38 are tight fit. More specifically, it is assumed that the control pin 48 is press-fit into the pin insertion hole 38 and fastened to the control shaft 16. On the other hand, the adjustment pin 50 and bearing hole 44 are clearance fit. In other words, the adjustment pin 50 can rotate within the bearing hole 44.

In the state shown in FIG. 3, the control pin 48 is in contact with (abuts on) the adjustment pin 50. This inhibits the control member 26 from rotating clockwise relative to the control shaft 16 as viewed in FIG. 3. Therefore, when the control shaft 16 rotates counterclockwise as viewed in FIG. 3, the control pin 48 pushes the adjustment pin 50, thereby causing the control member 26 to rotate together with the control shaft 16.

When the cam 14 rotates clockwise in the variable valve mechanism 10 shown in FIG. 1, the slider roller 22 is pulled leftward as viewed in the figure in accordance with the rotation of the cam 14. The force applied to the slider roller 22 is then transmitted to the control member 26 through the intermediate arm 24. As a result, force is constantly applied to the control member 26 to rotate it clockwise as viewed in the figure. This force constantly presses the adjustment pin 50 against the control pin 48. While the cam 14 rotates, that is, the internal combustion engine operates, therefore, clockwise rotation of the control shaft 16 does not separate the control pin 48 from the adjustment pin 50.

As described above, even when the control shaft 16 rotates clockwise or counterclockwise during an internal combustion engine operation, the control member 26 rotates together with the control shaft 16. A pushing member (lost motion spring) may be added to force the control member 26 to rotate clockwise as viewed in the figure for the purpose of preventing the control pin 48 from leaving the adjustment pin 50 with increased certainty.

Figure 4:
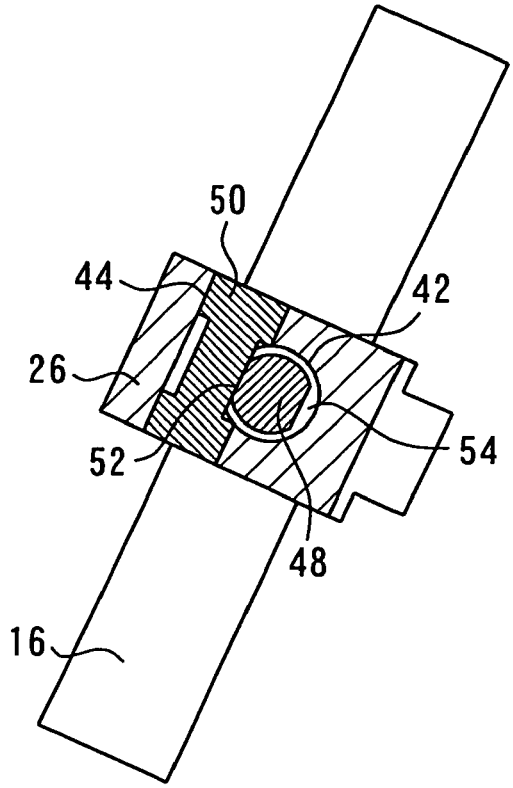
FIG. 4 is a cross-sectional view taken along line X-X of FIG. 3.

FIG. 4 is a cross-sectional view taken along line X-X of FIG. 3. As shown in FIG. 4, the contact face 52 between the control pin 48 and adjustment pin 50 is positioned lower than the cylindrical parts on both ends of the adjustment pin 50. Since the employed configuration is as described above, the adjustment pin 50 does not back out of the bearing hole 44 as far as the control pin 48 is in contact with the adjustment pin 50. Therefore, the present embodiment does not need to use any additional part for preventing the adjustment pin 50 from backing out of the bearing hole 44. This makes it possible to reduce the number of required parts and make assembly easy, thereby contributing toward cost reduction.

In FIG. 3, the relative angle (mounting angle) between the control member 26 and control shaft 16 can be expressed as the angle θ between a straight line passing through the center of the control shaft 16 and the center of the bearing hole 44 (adjustment pin 50) and the center line of the control pin 48. The angle θ is determined by the distance A between the center line of the bearing hole 44 and the center line of the control pin 48. The present embodiment can change the angle θ by replacing the adjustment pin 50 with another having a different dimension B that represents the distance between the center line of the adjustment pin 50 and the contact face 52 between the control pin 48 and adjustment pin 50. The operating angle of the intake valve 12 can be adjusted (fine-tuned) by changing the angle θ.

More specifically, when the adjustment pin 50 is replaced with another having a greater dimension B, the distance A increases to increase the angle θ. The angle of the control member 26 then changes slightly clockwise as far as the rotary angular position of the control shaft 16 remains unchanged. This decreases the operating angle of the intake valve 12. In other words, the operating angle of the intake valve 12 can be fine-tuned in the decreasing direction by replacing the adjustment pin 50 with another having a greater dimension B. Conversely, the operating angle of the intake valve 12 can be fine-tuned in the increasing direction by replacing the adjustment pin 50 with another having a smaller dimension B.

After the variable valve mechanism 10 is assembled, the operating angle adjustment mechanism described above is used to equalize the intake valve operating angles of all cylinders. It is assumed that a plurality of (many) adjustment pins 50 differing in dimension B are prepared for the above adjustment.

When the variable valve mechanism 10 is to be assembled for the first time, an adjustment pin 50 whose dimension B is equal to a predetermined reference value is used. After completion of assembly, the control shaft 16 is rotated to a predetermined reference rotary angular position. In the resulting state, the operating angle of the intake valve 12 for each cylinder is measured. If the measurement results indicate that the operating angle varies from one cylinder to another, the adjustment pin 50 for each cylinder is replaced with another having a different dimension B in accordance with the difference between the measured value of each cylinder and a predetermined reference value or design value. More specifically, the adjustment pin 50 for a cylinder that is to be fine-tuned to increase the operating angle is replaced with another whose dimension B is smaller than the reference value. Conversely, the adjustment pin 50 for a cylinder that is to be fine-tuned to decrease the operating angle is replaced with another whose dimension B is greater than the reference value.

The adjustment pin 50 can be replaced as described below. As shown in FIGS. 3 and 4, on the side opposite the adjustment pin 50, there is a gap 54 between the control pin 48 and the inner wall of the pin receiver hole 42. Therefore, when the control member 26 is rotated counterclockwise by the amount of gap 54 relative to the control shaft 16 as viewed in FIG. 3, the control pin 48 does not interfere with the inside of the circle of the bearing hole 44. In this state, the adjustment pin 50 can be inserted into or backed out of the bearing hole 44.

When the adjustment pin 50 is replaced to change the angle θ, the angle of the contact face 52 between the control pin 48 and adjustment pin 50 relative to the control member 26 also changes. In this instance, the present embodiment, in which the adjustment pin 50 can rotate within the bearing hole 44, can absorb the change in the angle of the contact face 52 and properly maintain the surface contact of the contact face 52. This makes it possible to accurately prescribe the relative angle between the control shaft 16 and control member 26 and adjust the operating angle of the intake valve 12 with high precision. Further, the surface contact of the contact face 52 can be properly maintained. This makes it possible to decrease the surface pressure of the contact face 52 and reduce the wear of the contact face 52 (the wear of the adjustment pin 50 and control pin 48) during an internal combustion engine operation. Therefore, it is also possible to definitely prevent an adjusted operating angle from becoming incorrect.

In particular, the present embodiment uses a flat contact face 52. This makes it possible to avoid uneven contact and reduce the surface pressure. In addition, the adjustment pin 50 and control pin 48 can be fabricated with ease.

Further, the control member 26 for the variable valve mechanism 10 according to the present embodiment can be manufactured by forming the bearing hole 44 and performing other simple fabrication procedures. The parts required for operating angle adjustment are limited to the control pin 48 and adjustment pin 50. In addition, the number of required parts is small. Moreover, since the adjustment pin 50 and bearing hole 44 are clearance fit, the adjustment pin 50 can be inserted with ease.

Furthermore, the adjustment pin 50 and control pin 48 are merely in contact with each other. While the variable valve mechanism 10 operates, therefore, no strong force is exerted to pull the control pin 48 out of the pin insertion hole 38 in the control shaft 16. Therefore, the control pin 48 can be easily press-fit into the pin insertion hole 38 with relatively small force. This makes it possible to employ a simplified press-fitting process and avoid applying strong force to the control shaft 16 during press-fitting. Consequently, it is possible to definitely prevent the control shaft 16 from being distorted, deformed, or otherwise damaged.

In addition, the above-described operating angle adjustment mechanism, which is included in the variable valve mechanism 10, can be used after assembly to accurately adjust the operating angle of the intake valve 12. Therefore, the dimensional accuracy required for various pins and the holes in various component members is not so high. Consequently, dimensional tolerance can be loosened to reduce the fabrication cost. Further, assembly can be achieved with ease to provide improved productivity.

As described above, the variable valve mechanism 10 makes it possible to adjust the operating angle of the intake vale 12 with high precision while providing increased ease of assembly and reducing the manufacturing cost.

In the first embodiment, which has been described above, the slider roller 22 corresponds to the "intermediate member" according to the first aspect of the present invention; the intermediate arm 24 corresponds to the "coupling member" according to the first aspect of the present invention; and the adjustment pin 50 corresponds to the "adjustment member" according to the first aspect of the present invention.

Second Embodiment

A second embodiment of the present invention will now be described with reference to FIGS. 5 and 6. However, the differences between the second embodiment and the above-described first embodiment will be mainly described while abridging or omitting the description of matters common to these embodiments.

Figure 5:
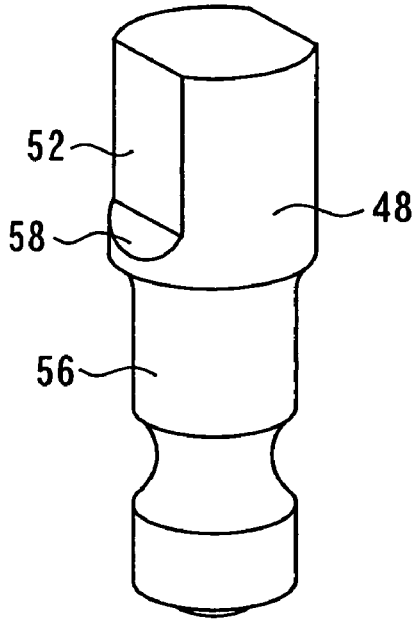
FIG. 5 is a perspective view illustrating control pin according to a second embodiment of the present invention.

FIG. 5 is a perspective view illustrating the control pin 48 according to the second embodiment. This control pin 48 has a protruding part 58, which is positioned between the contact face 52 between the control pin 48 and adjustment pin 50 and an insert 56 to be inserted into the pin insertion hole 38 in the control shaft 16.

Figure 6:
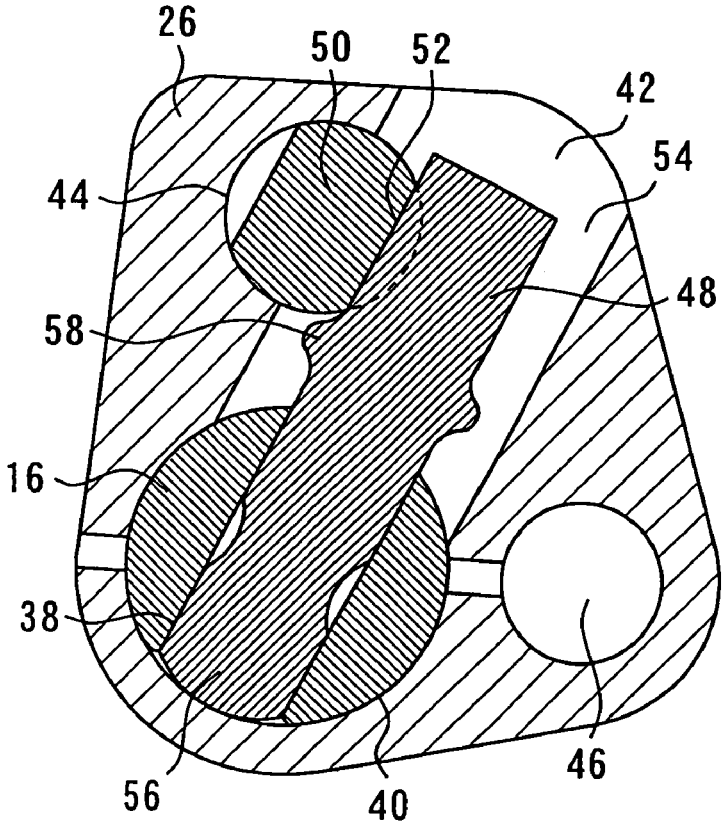
FIG. 6 is a cross-sectional view of the assembled control shaft and control member according to the second embodiment taken in a plane perpendicular to the control shaft.

FIG. 6 is a cross-sectional view of the assembled control shaft 16 and control member 26 according to the second embodiment taken in a plane perpendicular to the control shaft 16. In the present embodiment, the insert 56 of the control pin 48 and the pin insertion hole 38 are clearance fit. More specifically, the control pin 48 is not fastened to the control shaft 16 and can be inserted into and backed out of the pin insertion hole 38. Therefore, the present embodiment eliminates the necessity of performing a process for press-fitting the control pin 48 into the pin insertion hole 38. Consequently, assembly can be achieved with increased ease. Meanwhile, after completion of assembly, the protruding part 58 is locked by the adjustment pin 50 as shown in FIG. 6. Therefore, the control pin 48 does not back out of the pin insertion hole 38 as far as the control pin 48 is in contact with the adjustment pin 50. Consequently, it is not necessary to use any additional part for preventing the control pin 48 from backing out of the pin insertion hole 38. This makes it possible to reduce the number of required parts and facilitate assembly.

In the present embodiment, the operating angle of the intake valve 12 can be adjusted either by replacing the adjustment pin 50 as is the case with the first embodiment or by replacing the control pin 48. More specifically, when many control pins 48 differing in the dimension between the center line of the control pin 48 and the contact face 52 are prepared, the operating angle can be adjusted by selectively using one of the prepared control pins 48.

Third Embodiment

A third embodiment of the present invention will now be described with reference to FIGS. 7 to 9. However, the differences between the third embodiment and the above-described first embodiment will be mainly described while abridging or omitting the description of matters common to these embodiments.

Figure 7:
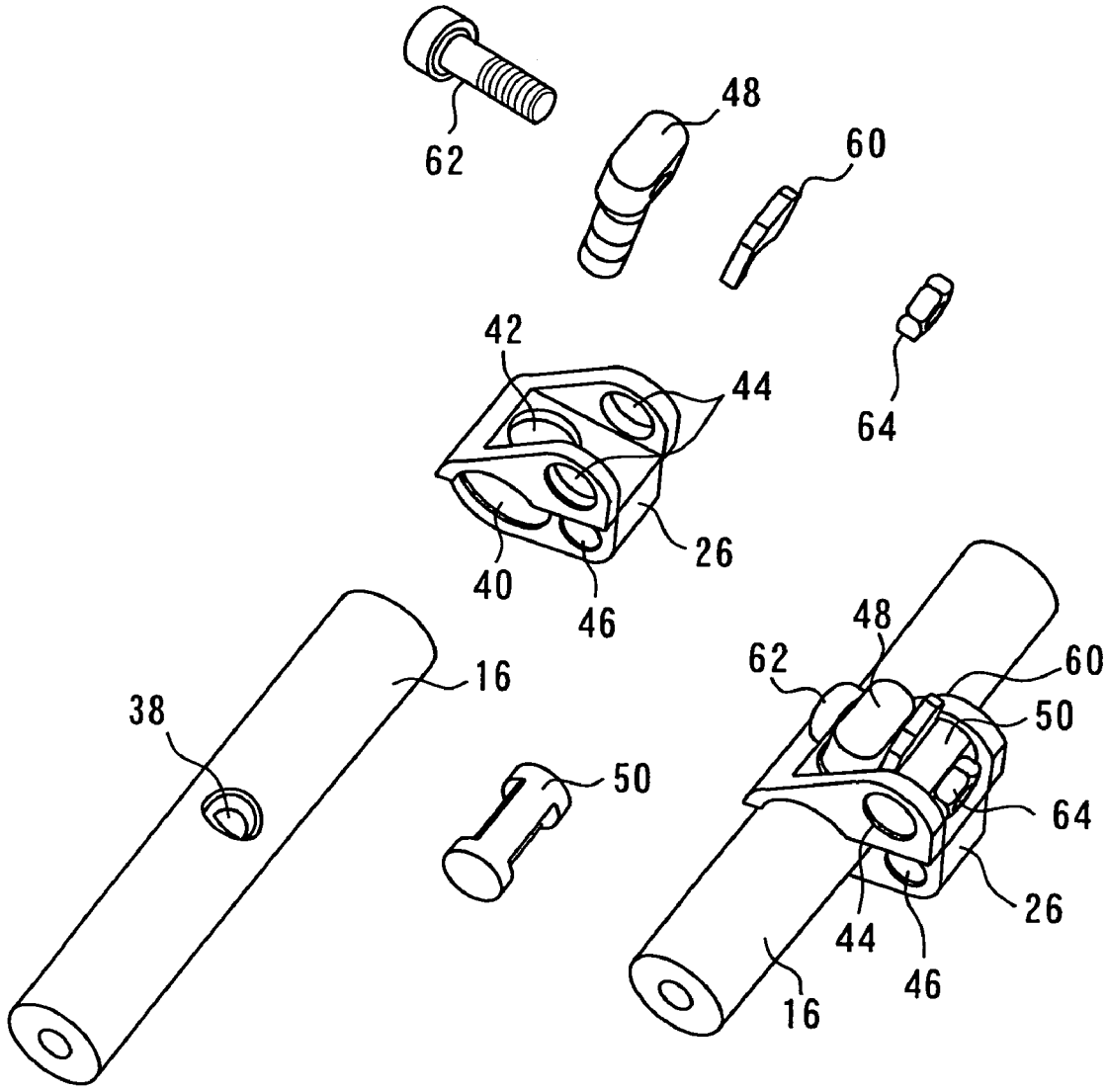
FIG. 7 shows perspective views illustrating the exploded state and assembled state of the control shaft and control member according to a third embodiment of the present invention.

FIG. 7 shows perspective views illustrating the exploded state and assembled state of the control shaft 16 and control member 26 according to the third embodiment. As shown in FIG. 7, a shim 60 is sandwiched between the control pin 48 and adjustment pin 50, and the control pin 48 and adjustment pin 50 are secured (coupled together) with a bolt 62. In addition, a nut 64 is provided to lock the bolt 62.

Figure 8:
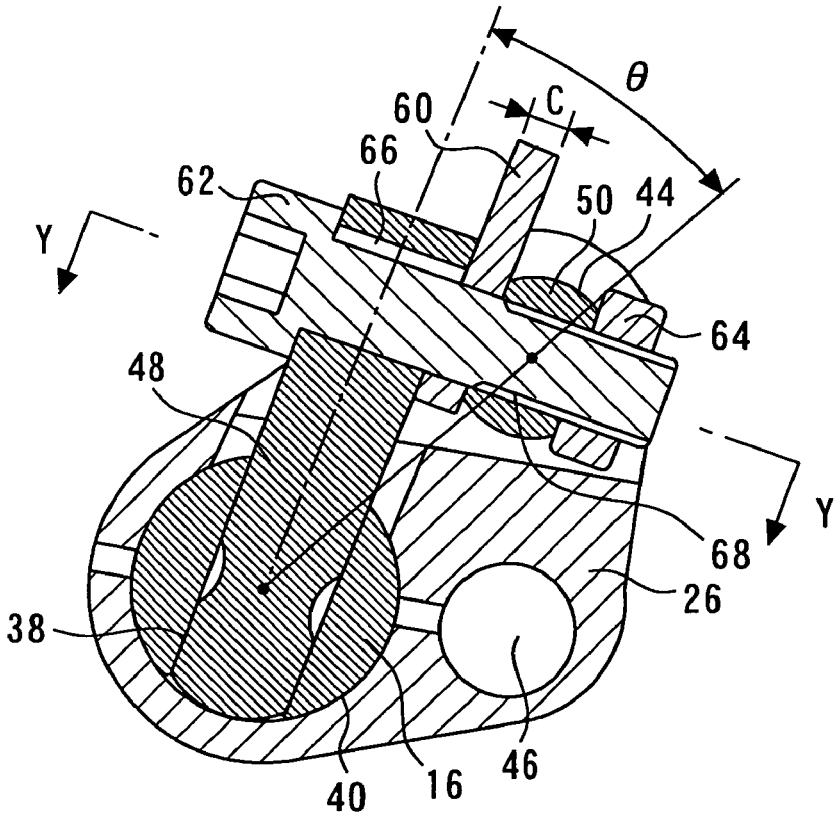
FIG. 8 is a cross-sectional view of the assembled control shaft and control member according to the third embodiment taken in a plane perpendicular to the control shaft.
Figure 9:
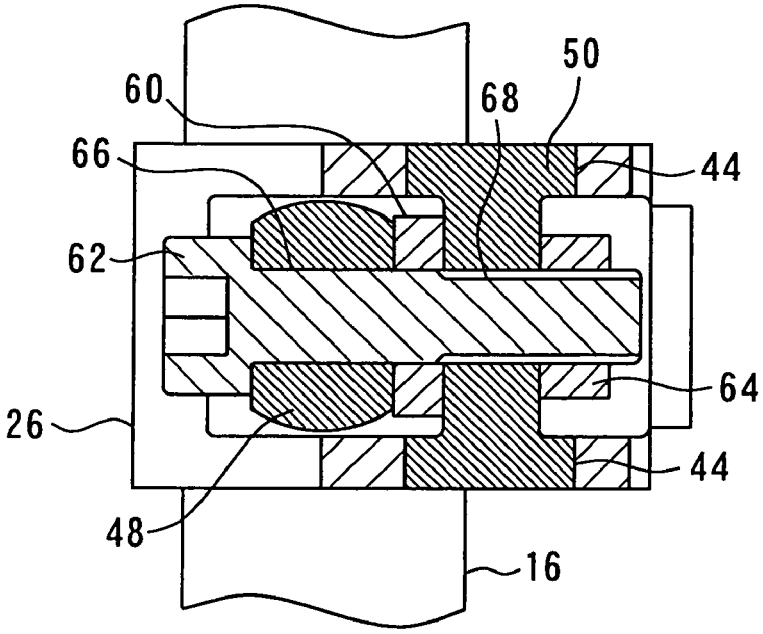
FIG. 9 is a cross-sectional view taken along line Y-Y of FIG. 8.

FIG. 8 is a cross-sectional view of the assembled control shaft 16 and control member 26 according to the third embodiment taken in a plane perpendicular to the control shaft 16. FIG. 9 is a cross-sectional view taken along line Y-Y of FIG. 8. As shown in FIGS. 8 and 9, the control pin 48 has a bolt insertion hole 66 into which the bolt 62 is to be inserted. The adjustment pin 50 has a screw hole 68, which has a female thread for screwing onto a male thread of the bolt 62. The bolt 62 is inserted into the bolt insertion hole 66 and screwed into the screw hole 68 for tightening purposes. This ensures that the control pin 48, shim 60, and adjustment pin 50 are coupled together and secured by the bolt 62. Therefore, the present embodiment can also be applied to a situation where bidirectional turning force is exerted between the control shaft 16 and control member 26.

The leading end of the bolt 62 is passed through the screw hole 68 and protruded toward the opposite side. The nut 64 is threaded onto the protruding part for tightening purposes. In the present embodiment, which includes the nut 64, the screw hole 68 in the adjustment pin 50 and the nut 64 function as a double nut. This makes it possible to definitely prevent the bolt 62 from loosening even when the angular acceleration of the control shaft 16 drastically changes during an operation of the variable valve mechanism 10, thereby oscillating the turning force exerted between the control shaft 16 and control member 26.

The shim 60 is shaped like a two-pronged part. The shim 60 is positioned over the bolt 62 so that the bolt 62 is positioned between the two prongs as viewed in FIG. 8. Therefore, the shim 60 can be replaced when the bolt 62 is loosened. In the present embodiment, the relative angle θ between the control member 26 and control shaft 16 can be changed by replacing the shim 60 with another having a different thickness C. This makes it possible to adjust the operating angle of the intake valve 12.

When the shim 60 is replaced to change the angle θ, the angle of the contact face between the control pin 48, shim 60, and adjustment pin 50 relative to the control member 26 also changes. In this instance, the adjustment pin 50 rotates within the bearing hole 44, as is the case with the first embodiment, to absorb the above angular change of the contact face, thereby properly maintaining the surface contact of the contact face. Consequently, the third embodiment provides the same advantages as the first embodiment.

Further, when the angle θ changes, the positional relationship between the control pin 48 and bolt 62 also changes. More specifically, when the shim 60 is replaced with a thinner one to reduce the angle θ in a situation where the employed configuration is as shown in FIG. 8, the position of the bolt 62 relative to the control pin 48 moves upward as viewed in the figure. A gap is provided between the bolt insertion hole 66 and bolt 62 to allow such a bolt position change. More specifically, the bolt insertion hole 66 is elongated in the up-down direction as viewed in FIG. 8 to form a gap above the bolt 62. Since such a gap is provided, it is possible to definitely prevent the bolt 62 from interfering with the inner circumferential surface of the bolt insertion hole 66 even when the shim 60 is replaced to change the angle θ. This makes it possible to properly maintain the surface contact between the control pin 48, shim 60, and adjustment pin 50. As a result, the operating angle of the intake valve 12 can always be adjusted with high precision.

In the present embodiment, the control pin 48 and the pin insertion hole 38 in the control shaft 16 may be either tight fit (press-fit) or clearance fit. Even when the control pin 48 and pin insertion hole 38 are clearance fit, the control pin 48 does not back out of the pin insertion hole 38 because it is secured with the bolt 62. When the control pin 48 and pin insertion hole 38 are clearance fit, it is possible to facilitate fabrication and achieve assembly with ease.

In the third embodiment, which has been described above, the shim 60 corresponds to the "interposition member" according to the first aspect of the present invention.

The invention claimed is:

1. A variable valve mechanism comprising:

a cam which is mounted on a camshaft of an internal combustion engine;

an intermediate member which is positioned in the course of a path for transmitting the lift of the cam to a valve;

a control shaft which can vary the rotary angular position continuously or stepwise;

a control member which is installed to be rotatable around the control shaft;

a lock mechanism for preventing the control member from rotating relative to the control shaft; and a coupling member for coupling the control member to the intermediate member;

the control shaft being rotated to change the position of the intermediate member and the operating angle of the valve is varied;

wherein the lock mechanism includes a control pin, which is inserted into a hole in the control shaft to protrude in the radial direction of the control shaft, a bearing hole, which is formed in the control member in parallel with the control shaft, and an adjustment member, which is rotatably supported by the bearing hole;

wherein the adjustment member and the control pin come into surface contact with each other directly or through an interposition member to inhibit the control member from rotating relative to the control shaft;

wherein the operating angle of the valve can be adjusted by replacing the adjustment member, the interposition member, or the control pin with another having a different dimension to change the distance between the center line of the bearing hole and the center line of the control pin and change the relative angle between the control shaft and the control member; and wherein the adjustment member rotates within the bearing hole to maintain the surface contact irrespective of the magnitude of the relative angle.

2. The variable valve mechanism according to claim 1, wherein the adjustment member is made of a substantially cylindrical pin.

3. The variable valve mechanism according to claim 1, wherein the surface contact is plane contact.

4. The variable valve mechanism according to claim 1, wherein the adjustment member and the control pin are in direct contact with each other; and wherein the operating angle of the valve can be adjusted by replacing the adjustment member with another having a different dimension between the center line thereof and the contact face relative to the control pin or by replacing the control pin with another having a different dimension between the center line thereof and the contact face relative to the adjustment member.

5. The variable valve mechanism according to claim 1, wherein the adjustment member and the control pin are in direct contact with each other;

wherein the adjustment member has cylindrical parts, which are provided on both ends and in contact with the inner circumferential surface of the bearing hole; and wherein the adjustment member's contact face relative to the control pin is positioned between the cylindrical parts and lower than the cylindrical surfaces thereof.

6. The variable valve mechanism according to claim 1, wherein the control pin is inserted into the hole in the control shaft in a clearance-fit manner;

wherein the adjustment member and the control pin are in direct contact with each other; and wherein the control pin has a protruding part, which is positioned between the contact face relative to the adjustment member and an insert placed in the hole in the control shaft.

7. The variable valve mechanism according to claim 1, wherein the lock mechanism further includes a screw hole bored through the adjustment member, a bolt insertion hole bored through the control pin, a bolt for fastening the adjustment member to the control pin by running through the bolt insertion hole and screwing into the screw hole, and a nut screwed on a male thread of the bolt protruding through the screw hole; and wherein a gap is provided between the bolt insertion hole and the bolt to allow a bolt position change that occurs when the relative angle between the control shaft and the control member is changed.

8. The variable valve mechanism according to claim 1, further comprising:

a rocker arm for pushing the valve;

a rocker roller which is mounted on the rocker arm;

a swing arm which is installed to be swingable around the control shaft and swings when the, cam rotates;

a swing cam surface which is formed on the swing arm and brought into contact with the rocker roller; and a slider surface which is formed on the swing arm and positioned to face the cam;

wherein the intermediate member is positioned between the cam and the slider surface to move toward or away from the center of the control shaft when the control shaft rotates.

* * * * *